US006889474B2

(12) United States Patent
Wesdock

(10) Patent No.: US 6,889,474 B2
(45) Date of Patent: May 10, 2005

(54) DECORATIVE WINDOW CAP

(76) Inventor: James F. Wesdock, R.D. 3, Box 325, Reynoldsville, PA (US) 15851

( * ) Notice: Subject to any disclaimer, the term of this patent is extended or adjusted under 35 U.S.C. 154(b) by 185 days.

(21) Appl. No.: 10/384,761

(22) Filed: Mar. 11, 2003

(65) Prior Publication Data

US 2004/0177565 A1 Sep. 16, 2004

(51) Int. Cl.[7] ..... E04B 1/34
(52) U.S. Cl. ..... 52/74; 52/211; 52/204.53
(58) Field of Search ..... 52/204.2, 211, 52/212, 204.53, 204.54, 74

(56) References Cited

U.S. PATENT DOCUMENTS 5,768,833 A * 6/1998 Golen ..... 52/212
5,802,785 A * 9/1998 Crook ..... 52/204.53
6,112,481 A * 9/2000 Schiedegger et al. ..... 52/211
6,212,835 B1 * 4/2001 Schiedegger et al. ..... 52/211
6,276,101 B1 * 8/2001 Schiedegger et al. ..... 52/211
6,360,500 B1 * 3/2002 Wilcox ..... 52/211 X
6,457,287 B1 * 10/2002 Wilcox ..... 52/211 X
6,691,474 B2 * 2/2004 Richardson ..... 52/204.53
2001/0017014 A1 * 8/2001 Richardson ..... 52/204.53

* cited by examiner

*Primary Examiner*—Rodney B. White

(57) ABSTRACT

A decorative window cap made of polyvinyl chloride for mounting on a house exterior sidewall above a window or windows to enhance the aesthetic value of the house, home, to color blend and coordinate with existing polyvinyl chloride decorative window shutters, and to break up the vertical plainness of the house sidewall.

4 Claims, 7 Drawing Sheets

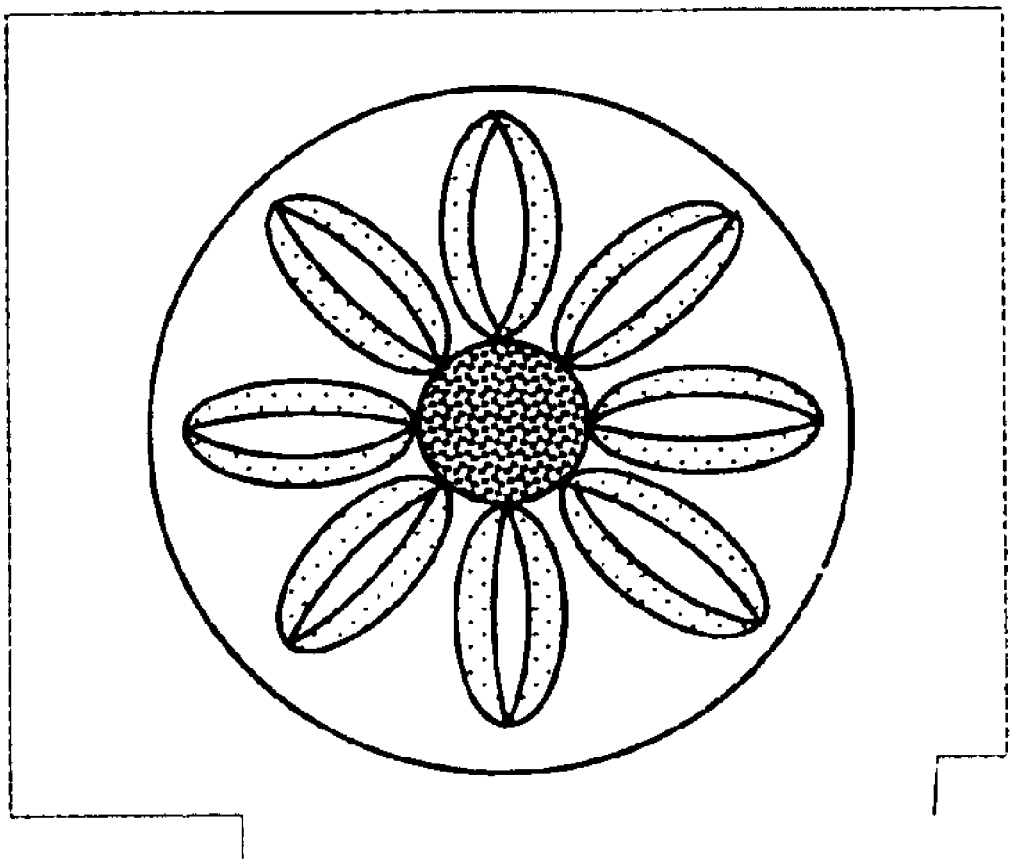
FIG. 9
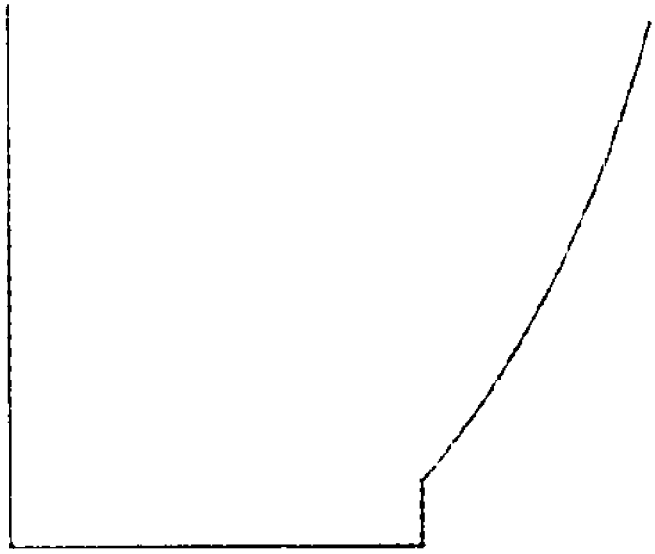

DECORATIVE WINDOW CAP

CROSS-REFERENCE TO RELATED APPLICATIONS

U.S. Pat. Nos. 6,470,639 5,782,052 4,796,393.

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISC APPENDIX N/A

BACKGROUND OF INVENTION

1. Field of the Invention

This invention relates to home exterior sidewall and window enhancement devices such as decorative window shutters, awnings, pediments and so forth.

2. Description of Prior Art

Looking around any residential neighborhood even the casual observer will notice a vertical straightness and plainness, an unadorned makeup, a non-aesthetic appearance, of the sides of houses, homes, particularly at the tops of, or above the windows. Siding in itself, aluminum, and in particular more recently, vinyl, has done much to enhance and bring about a lasting exterior good look. The vinyl siding acts like a permanent skin of new paint, is lightweight and strong, and the material color is indefinitely retentive. And, in particular, it has been the windows that are continuously, thoughtfully, and carefully being designed and redesigned to not only provide a port of light but also a lasting and increasingly available aesthetic beauty for the house, the home.

In addition, some designers, manufacturers, and builders provide such items as pediments, mantels, planters, headers, crossheads, moldings, awnings and canopies, and shutters for further exterior sidewall enhancement and beautification, particularly around and about the windows. Some of these items are very decorative, artistic, and aesthetically appealing. But, these items are, except the awnings, more or less two dimensional in their makeup; that is, they are still included in the vertical sidewall plane and do not protrude from that plane to break up the unencumbered straight vertical wall. It remains a plane of plainness. Also, these items are expensive especially if they are made of molded polyethylene or polyurethane or machined from wood. Also, they are usually a part of the original permanent construction or makeup of the house and require expertise in their installation, placement, and sealing.

Awnings and canopies, above windows and doors, do provide sun shading, and do provide relief from direct exposure to the weather, and do aesthetically break up this vertical sidewall plainness. Such awnings can be made of canvas, aluminum, wood, and of other man made materials.

Awnings made of flexible canvas usually have a slanting single piece top cover and vertical side panels, all of which may have extending scalloped fringe valances. This type of awning is usually supported beneath by aluminum or steel tubing or bracketed framework that is attachable to the side of the house. These types of awnings can be retractable or fixed.

Aluminum awnings are usually made up of multiple adjacent overlapping stacked and joined together, either horizontally or vertically, ribbed and rigid, long and narrow, aluminum sheet pieces in various lengths and widths to make up an awning structure. They also have a supporting frame that is attachable to the side of the house. Aluminum awnings are usually non-retractable and permanently fixed.

Awnings of both types, canvas or aluminum, have their specific purposes, and their specific advantages and disadvantages. If well kept up and maintained, they provide a welcomed house feature. If not maintained, their color can fade, bleach, and wash out from constant exposure to the elements. And canvas can and does tear, and aluminum can and does bend. Both are relatively heavy and thus somewhat difficult to install. Also, the underside of the awning and the siding directly beneath the awning are subject to dirt buildup and streaking. Both types are subject to ice and snow damage and both can catch the wind as a sail and thus break up or tear even though attachment means can be heavily structurally made. Also, usually the color scheme of both canvas and metal awnings does not coordinate nor blend in well with the house siding nor other decorative devices colors such as decorative window shutters. They also do not completely aesthetically fill the void that exists, and still can readily be seen above the tops of the windows, even when the awnings are in place.

And it is the decorative window shutters, polyvinyl chloride (PVC) shutters in particular, which have caught on and excelled. They provide a welcomed and good looking, colorful enhancement to new and old houses alike. They do not color fade and through good structural design they retain their shape and rigidity. Most houses have these shutters and they are still profusely being manufactured and installed. And even as these shutters are extremely popular and have provided a definite aesthetic enhancement to the sides of houses and to the windows themselves, they, in doing so, unfortunately further contribute to an increase in the already present ornamental void at the tops of the windows. Also, the ornamental shutters, being in and a part of the vertical plane of the house sides, do not break up that plane of plainness.

Consequently, the need exists, the value becomes apparent, for a device, to aesthetically enhance the tops of windows and to break up the house vertical side plainness. The device needs to be pleasant and comfortable. It needs to be streamlined for looks, efficiency, and wind resistance. It needs to be made of polyvinyl chloride like the shutters themselves, to be strong yet resilient, sturdy, and long lasting. It needs to be made of polyvinyl chloride to be colorful, color retentive, and able to be color coordinated to the polyvinyl chloride decorative shutters and to the vinyl siding itself. It needs to be designed and structurally made to fit with, and matched to, the window decorative shutters and the siding.

BRIEF SUMMARY OF THE INVENTION

This device is unique, novel, in that it is not an awning since it is not intended to provide window shading and protection from the natural elements such as the wind, rain, etc. It is not a pediment, crosshead, nor a decorative trim assembly in that it is not a part of the original building structure. Rather, it is an add-on, ornamental decorative attachment to the building around and about the windows in a similar vein as decorative window shutters. Thus, it can most appropriately be described as a decorative window cap, a decorative device to cover or cap the top of, and in this case to cover or cap the top of a house window or windows.

And, similarly as with decorative window shutters, the main intent of this device is to enhance the aesthetic value, add to the beauty of a house, a home. This can be accomplished by using this device in conjunction with the decorative window shutters, or alone.

Consequently, the object of this invention is:

to provide a device, a window cap, to enhance the beauty of a house, a home, about and around the windows;

by designing and constructing this window cap to be in itself aesthetically appealing;

by using this window cap to beautify a currently existing aesthetic void above the tops of windows;

by using this window cap in an aesthetically pleasing way to break up the vertical plainness of the sides of houses;

by using this window cap in conjunction with decorative window side shutters to obtain maximum aesthetic effects through color balancing, matching, mixing, and coordinating;

by mounting these window caps in unique and novel ways and arrangements, in an appealing manner, to self style a home.

And, to do this, this device is:

made of (PVC) polyvinyl chloride to be strong yet resilient; be long lasting, retain its shape, avoid cracking, and retain its color characteristics indefinitely;

available in colors matching and/or coordinating with decorative window shutters colors;

easily and effectively mountable to the house side and siding; readily and easily lengthened or shortened to fit the various window widths and other house sidewall lengths and widths;

mountable on the various siding types: i.e., plain, brick, stepped, and most others;

of light weight for ease of installation and to not be a weight burden to the house nor the siding to which it is attached;

stubby in nature, not gaudy, to insure that the device itself does not overkill the aesthetic ornamental situation trying to be obtained;

stubby in nature to avoid the pitfalls associate with lifting by the wind and collapsing due to the weight of ice and snow; streamlined and carefully designed for minimum wind resistance and for aesthetic appearance;

a relatively completely sealed unit to eliminate internal insect entrapment;

a relatively completely sealed unit to minimize the possibility of external or internal water retention or buildup;

a relatively completely sealed and covered unit to avoid mounting hardware deterioration;

a relatively completely sealed unit to keep mounting hardware covered for aesthetic purposes;

designed where all molded piece's sharp edges are rounded to provide mould release relief and also to provide a nice finished look;

purposely designed to be stout and hearty for strength and looks and not be flimsy and easily broken;

simple in design and makeup, and affordable.

And, more specifically, this device does this by having such overall features as:

a mounting arrangement where siding needs not to be cut away nor unsightly damaged;

a mounting arrangement that need not be perfectly flush nor need caulking nor sealing;

a mounting arrangement where strong, large, and lengthy lag screws go right through the siding to attach the unit directly to the internal wall of the house for a rigid and substantial support;

a rear draft port for minimizing wind resistance to avoid tearing away under extreme conditions;

a rear draft port for upward cleansing by the wind and downward cleansing by the rain;

a rear draft port to minimize the possibility of spider, wasp, hornet, and other insects, nest building on the underside;

a snap in arrangement that allows the major parts to be easily and securely installed and retained within each other.

And, this device has the following specific parts including:

blow molded PVC side plates for mounting purposes;

extruded PVC cover caps for strength and aesthetic purposes and to provide a window top cover;

molded PVC end caps for mounting and sealing purposes and to compensate for expansion and contraction of the cover caps;

blow molded PCV extension brackets to allow for extra wide decorative cap lengths;

molded, machined, or extruded PVC siding wedges specifically designed for a no nonsense positive and secure mounting arrangement as necessary and to fit with most types of stepped siding;

stainless steel lag screws for mounting purposes.

BRIEF DESCRIPTION OF THE DRAWINGS

FIG. 9 is a plan view of a representative design for side plate embossed decoration.

Figure 10:
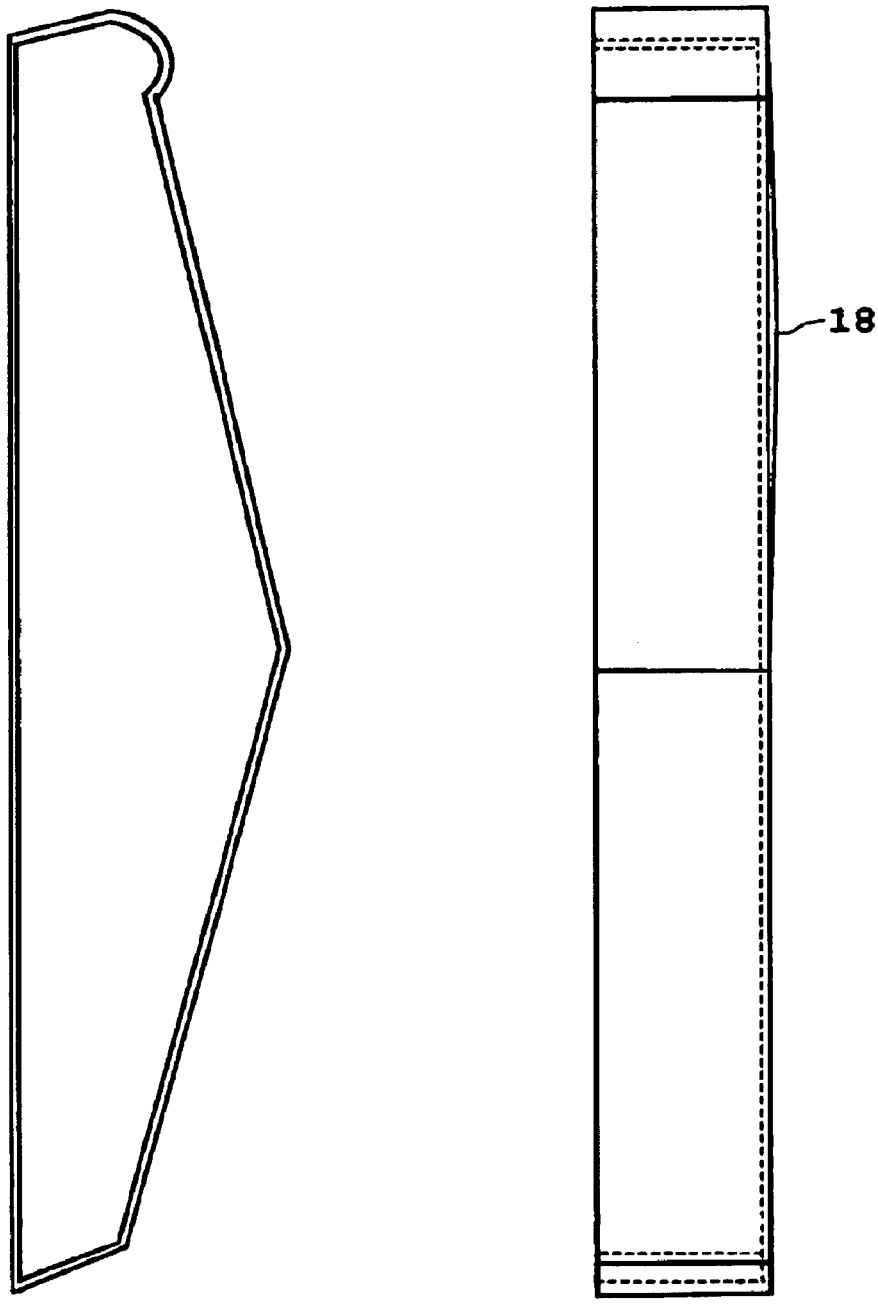

And, FIG. 10 is a detail view of the LH end cap showing the 1/16" expansion bulge.

DETAILED DESCRIPTION OF THE INVENTION

Figure 1:
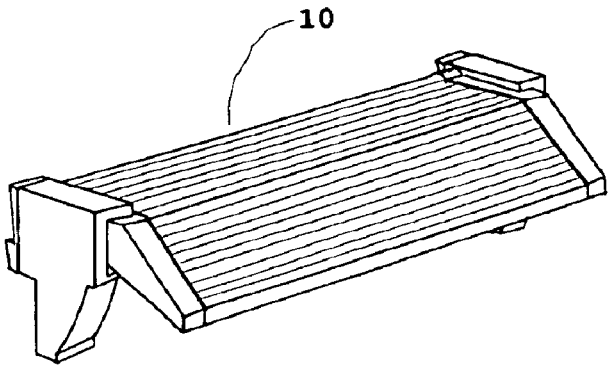
FIG. 1 is a perspective assembly view of the window cap.
Figure 2:
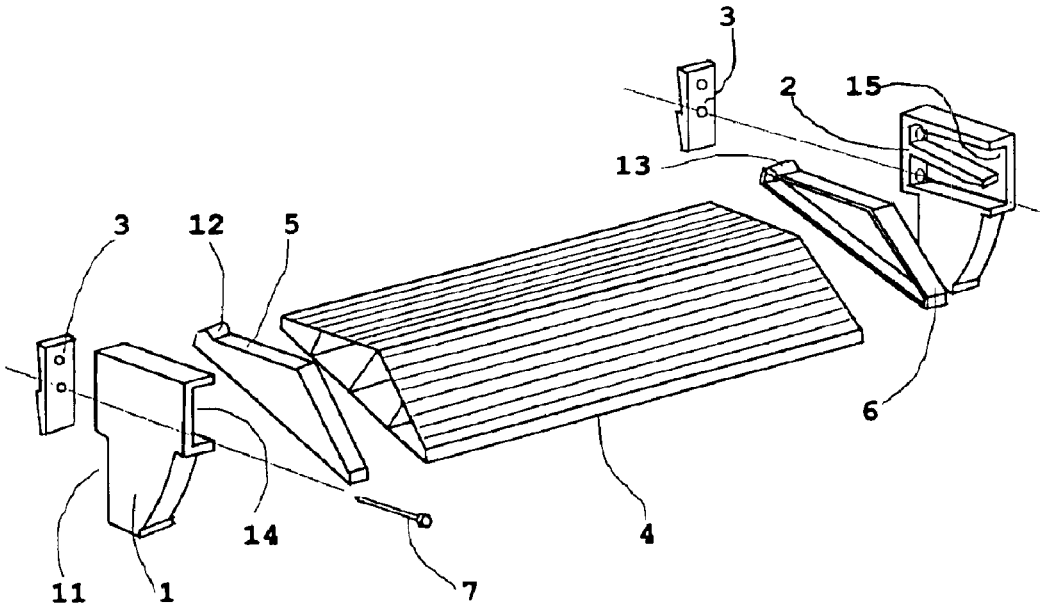
FIG. 2 is a perspective exploded view of the window cap.
Figure 3:
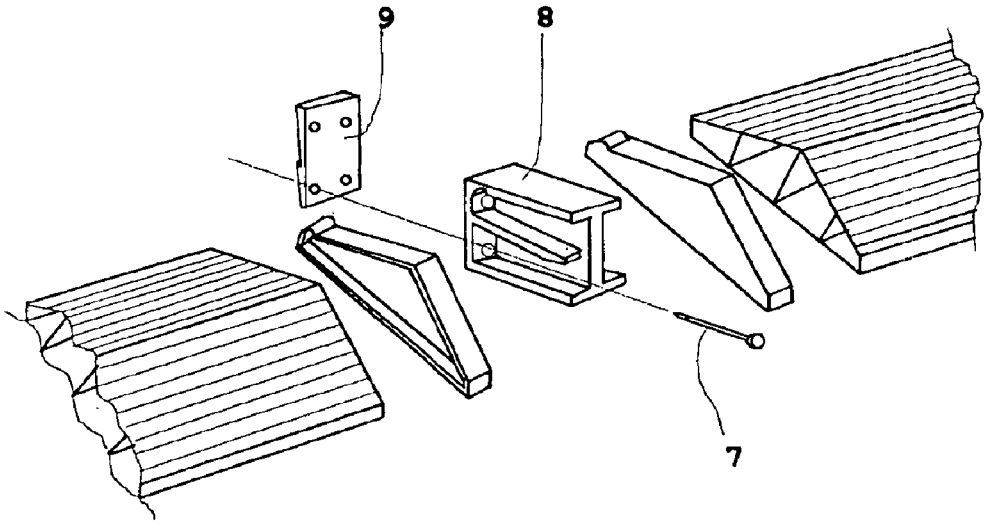
FIG. 3 is a perspective exploded partial view of the window cap showing the use of the extension bracket for lengthening the device.
Figure 4:
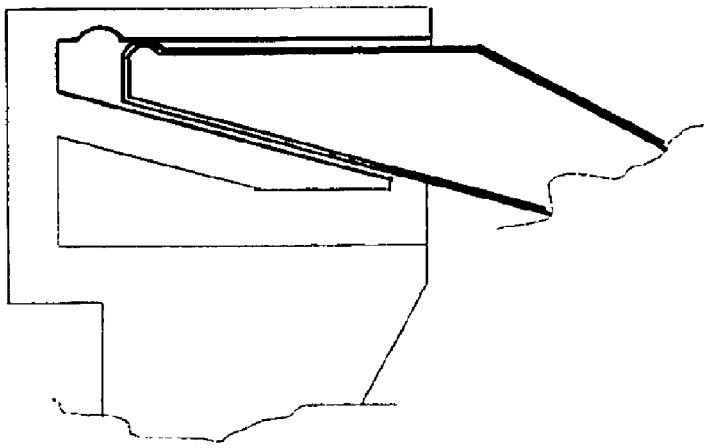
FIG. 4 is a plan view showing the end cap in position ready for snapping into the end plate retaining recess.
Figure 5:
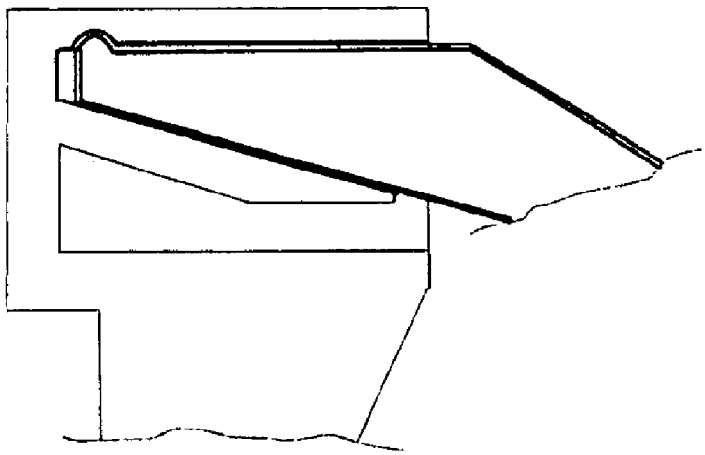
FIG. 5 is a plan view showing the end cap snapped into the end plate retaining recess.
Figure 6:
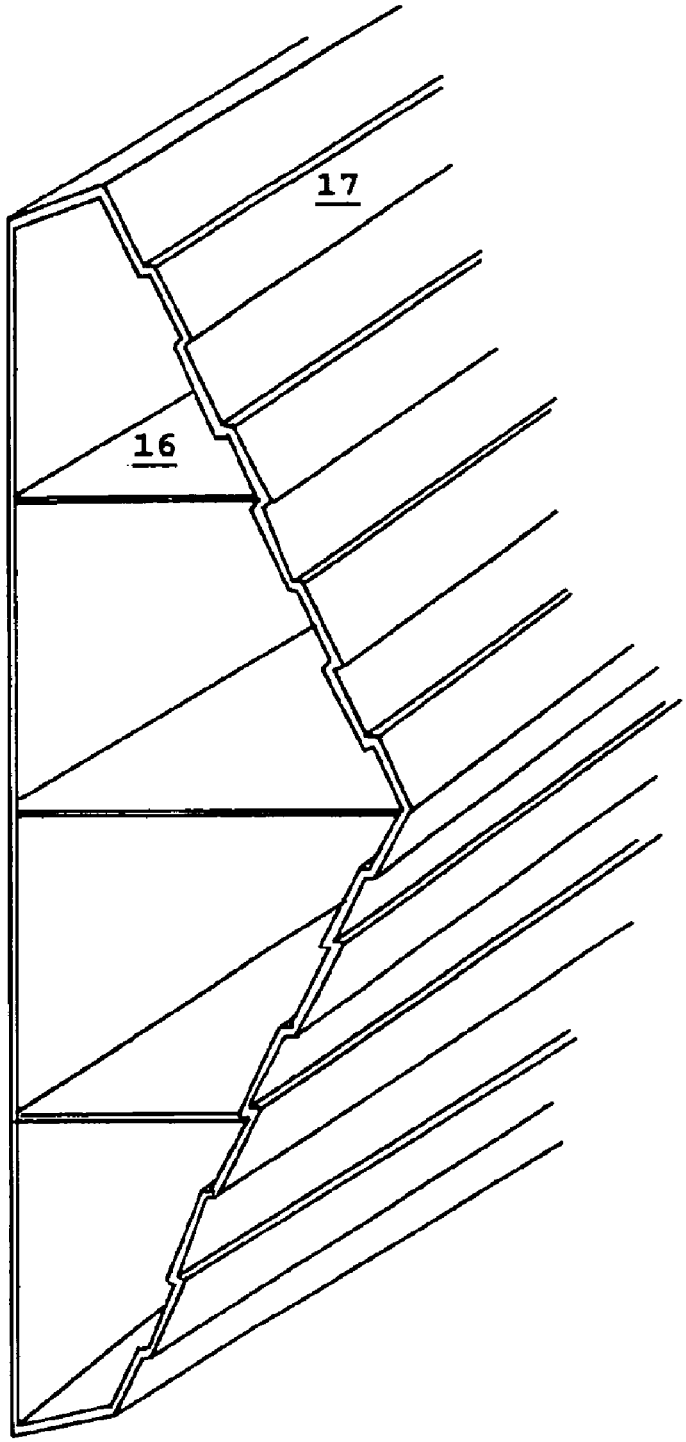
FIG. 6 is a perspective end view of the cover cap showing the internal and external ribbing.
Figure 7:
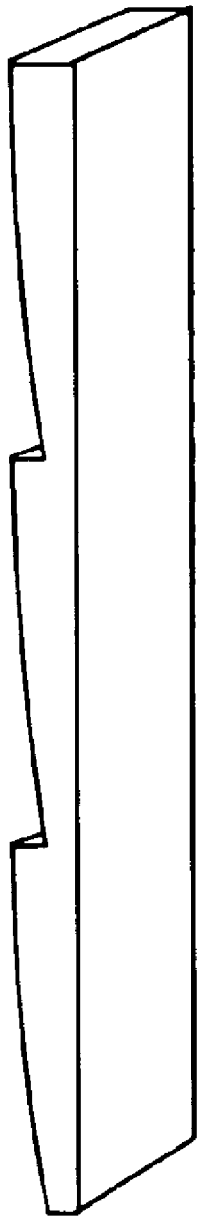
FIG. 7 is a perspective view of a representative siding wedge for 4" straight lapped siding.
Figure 8:
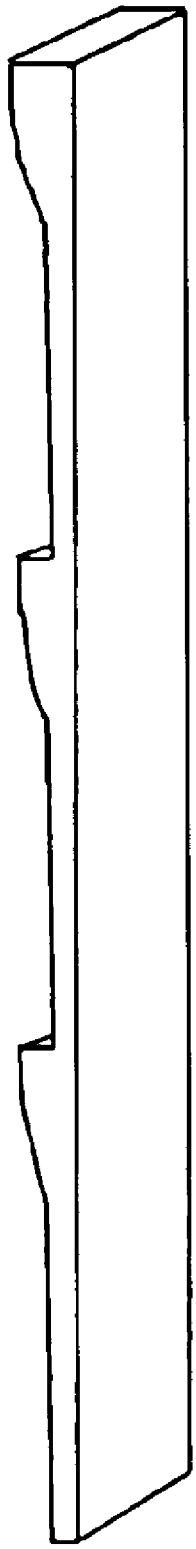
FIG. 8 is a perspective view of a representative siding wedge for 5" Dutch lap siding.

FIG. 1 shows the window cap assembly as it would be mounted above a window, door or other selected home sidewall locations. FIG. 2 shows that assembly exploded and FIG. 3, an exploded view, shows the use of the extension bracket. A detailed description for mounting this window cap best provides a detailed description of the parts and their makeup and function.

The blow molded PVC side plates 1 (RH), and 2 (LH), are mounted onto the sidewall of a house above and to the upper sides of a window. They are positioned level sufficiently above the window, and to the sides of the window, to allow the backs of the side plates 1 and 2, through the use of the recesses 11, to protrude down over existing, and in place, sidewall decorative window shutters, and leaving a 1" to 2" vertical gap in the recess. These side plate 1 and 2 locations and positions are held, and then marked on the siding of the house. Suitable 2¼" wide siding wedges 3, if necessary, are hand held, in place, on the siding at those marked locations, and are then appropriately cut from their 12" or 15" design length to the needed 7" compatible back side mounting length of the side plates 1 and 2.

The side plates 1 and 2 are then used as templates for the four screw hole locations that are marked through the side plate screw holes onto each siding wedge 3 piece. These siding wedge 3 holes are ⅜" clearance drilled to accept the 5/16" diameter totally threaded lag screws 7. These screw hole locations are then marked on the siding, using the siding wedges 3 as hole location templates. A 3/16" diameter× 2½" long pilot drill is used at those locations to drill through the siding and through the outer wall to provide a guide hole for the four, (only 1 shown), 5/16" lag mounting screws 7 which will attach the side plates 1 and 2 and the siding wedges 3 through the siding to the side of the house.

After side plates 1 and 2 are mounted, the distance is then measured between the inside of the two side plate recesses 14 and 15 to determine the length of the cover cap 4, required. The cover cap 4 length is determined as the internal distance between the two side plate recesses 14 and 15, less 3/32"+3/32" for the two end caps 5 and 6 thicknesses, less 1/16"+1/16" for the two end caps 5 and 6 expansion bulges 18, FIG. 10, less 1/16"+1/16" for clearance. This gives a total cover cap 4 length of 7/16" less than the total internal distance between the side plate recesses 14 and 15. The cut to shorten the cover cap 4 length, is made as perpendicular as possible with a chop saw or a radial arm saw using an abrasive type blade, not a metal or carbide tipped blade, and then the cut edges are deburred as necessary. A metal saw blade, even especial carbide tipped blades, may cause PVC material to crack or crumble. The end caps 5 and 6, can either be glued to the cover cap 4 by using PVC cement, or can be positioned loose (preferred). This cover cap assembly can now be pushed and snapped into place into the recesses of the already mounted side plates 1 and 2. The assembly and the mounting of this decorative window cap is now complete.

Further describing the drawings, cover cap 4, has standard lengths of 2', 2½', 3', 3½', 4', and 5'. Cutting of one of these lengths is usually necessary. However, it may be desirable to lengthen the entire decorative window cap beyond the 5' largest cover cap 4 standard length. To do this, the extension bracket 8 is positioned exactly level and even with the side plates 1 and 2 through the use of a snapped chalk line on the siding indicating its height location. Once the extension bracket 8 height and lateral position is mathematically determined, a 4" wide siding wedge 9 (if needed) is placed behind it, at the exact location. The siding wedge 9 positioned 7" length is ascertained and it is cut to that length. It is then ⅜" clear drilled, using the extension bracket 8 as a screw hole location template, to accept the four 5/16" diameter lag screws 7. These lag screws hole locations are transferred to the sidewall of the house by using the siding wedge 9 as a template and those locations are pilot drilled at 3/16"×2½" long to provide a guide hole for the four 5/16" lag screws 7 involved.

The total length of the decorative window cap, through the use of the extension brackets 8, is unlimited, within reason, to extend over 1, 2, 3, or more adjacent windows or even over two or several non-adjacent windows.

And, describing the drawings and the more specific design features of the parts, we have:

side plates 1 and 2, of blow molded PVC with a 0.096" wall thickness for strength and durability;

side plates 1 and 2 of blow molded PVC for light weight;

side plates 1 and 2 of blow molded PVC designed and built to provide a bendable, pliable, and flexible mount that "gives" to accept and retain "snap in" cover caps 5 and 6;

side plates 1 and 2 with recessed bottom sections 11, purposely designed to fit over and compliment decorative window shutters;

side plates 1 and 2 with plain showing ends or with ornamentally designed embossed showing ends FIG. 9;

side plates 1 and 2 of sufficient design strength to hold up under severe wind and snow and ice buildup;

side plates 1 and 2 of sufficient design strength to bear up under snugly tightened down mounting lag screws 7;

stainless steel 5/16"×3½" long hex head lag screws 7 mounting hardware for superior size and strength to mount the side plates and extension brackets;

molded, machined, or extruded PVC siding accessory wedges 3, that are a minimum of ⅜" solid thickness for rigidity and strength, for mounting to stepped external siding;

cover caps 4 that are extruded PVC with sidewall and rib thicknesses of 0.096" for strength and durability;

cover caps 4 in various standard lengths including 2', 2½', 3', 3½', 4' and 5';

cover caps 4 that can easily be cut, shortened, from the standard sizes, to provide the desired length to fit any window width;

cover caps 4 that are internally ribbed 16 to provide longitudinal strength to avoid warping or sagging of these horizontal members;

cover caps 4 that are internally ribbed 16 to provide strength against wind and strength against breaking due to loading of ice or snow;

cover caps 4 that are externally ribbed 17 to provide strength to avoid warping or dimpling or distortion of the cap external surface;

cover caps 4 that are externally ribbed 17 to produce a further aesthetically appealing appearance;

end caps 5 and 6 that are molded PVC to a thickness of 0.096" for strength and durability;

end caps 5 and 6 that fit flush against the cover cap ends 4 for a relatively sealed connection;

end caps 5 and 6 that are designed with rounded "snap-in" protrusion buttons 12 and 13;

end caps 5 and 6 the sides of which are slightly bowed or dished outward 1/16", 18, FIG. 10, so that these sides "give and take" to compensate for long length cover cap 5 and 6 expansion and contraction due to temperature changes;

blow molded PVC extension brackets 8 that are 0.096" in thickness for strength and durability;

blow molded extension brackets 8 for adjoining adjacent cover cap 4 portions to strengthen and align cover cap arrangements for horizontal runs longer than 5';

blow molded extension brackets 8 for adjoining adjacent cover cap 4 portions in any arrangement of incremental or shortened cover cap 4 lengths to suit the situation at hand and also to give the homeowner the opportunity to design an arrangement of various cover cap 4 lengths so as to position the extension brackets 8 at equally spaced, or chosen non-equally spaced increments to suit the homeowner's own decorative tastes;

blow molded extension brackets 8 for adjoining cover caps 4 in increments to any desired reasonable length, whether over several adjacent windows, or even to extend the cap cover 4 over two or several horizontally in-line non adjacent windows;

a rear draft port 10 that is 2" wide and extends the full length of the assembled cover cap;

an assembly feature where protruding cylindrical buttons on end plates 1 and 2 snap in and become firmly secured into the cylindrical grooves of PVC side plates 1 and 2 when the cover cap end plate assembly is pushed into side plates 1 and 2.

I claim:

1. A decorative window cap assembly for attachment to a building sidewall above a window comprising:

two blow molded polyvinyl chloride side plates having recessed rear bottom sections for a mounting arrangement over decorative window shutters, and each side plate having two countersunk mounting holes adapted for securing the window cap assembly to a building plain siding and stepped siding;

an extruded polyvinyl chloride cover cap, said cover cap having incrementally sized lengths, and being internally and externally ribbed for strength;

two molded polyvinyl chloride end caps for a mating slip fit over opposite ends of the cover cap and for a mating slide and snap fit into the side plates.

2. A decorative window cap of claim 1 further comprising:

an extension bracket wherein the decorative window cap can be lengthened to any reasonably desired length, to span one, several adjacent, or several non-adjacent windows, and wherein the extension brackets are adapted to be positioned for aesthetic purposes at selected spacing increments by using the various incrementally sized cover cap lengths, and by using saw cut cover caps for shortened lengths.

3. A decorative window cap of claim 1 wherein a rear draft port is built-in to provide relief from wind, insects, and caulking, wherein said rear draft port extends the full span length of the decorative window cap.

4. A decorative window cap of claim 1 wherein the end caps have a contour that is gradually angled from a midpoint on top of the end caps to both the front and rear of the end caps, the end caps having vertically protruding cylindrically shaped buttons at the rear of the rear gradually angled contour of the end caps, and wherein the rear gradually angled contour of the end caps slides into corresponding gradually angled mating recesses in the side plates and the extension brackets, and wherein the cylindrical shaped buttons on the end caps snap into mating vertically cylindrical recess button holes in the side plates and the extension brackets, and wherein the angles of approach together with the resiliency of the members, allows the end caps to reliably and securely slide and snap into place for piece to piece solid containment.

* * * * *